US010575609B2

(12) United States Patent
Sawh

(10) Patent No.: US 10,575,609 B2
(45) Date of Patent: Mar. 3, 2020

(54) UMBRELLA ACCESSORY

(71) Applicant: Fenton Sawh, Ottawa (CA)

(72) Inventor: Fenton Sawh, Ottawa (CA)

( * ) Notice: Subject to any disclaimer, the term of this patent is extended or adjusted under 35 U.S.C. 154(b) by 0 days.

(21) Appl. No.: 15/870,542

(22) Filed: Jan. 12, 2018

(65) Prior Publication Data

US 2018/0199682 A1 Jul. 19, 2018

Related U.S. Application Data

(60) Provisional application No. 62/446,097, filed on Jan. 13, 2017.

(51) Int. Cl.

| | |
|---|---|
| ***A45B 25/18*** | (2006.01) |
| ***A45B 25/10*** | (2006.01) |
| *A45B 25/00* | (2006.01) |

(52) U.S. Cl.

CPC ..... *A45B 25/10* (2013.01); *A45B 25/18* (2013.01); *A45B 2025/003* (2013.01)

(58) Field of Classification Search

CPC .. A45B 3/02; A45B 3/04; A45B 25/00; A45B 25/10; A45B 25/18; A45B 25/28; A45B 2200/1018; A45B 2200/1054; A45B 9/04; A45B 3/00; A45B 25/24; A45B 2025/186; A45B 2200/1009

USPC ..... 135/15.1, 16, 17, 33.2–33.41, 44, 48, 135/910; 362/102; 446/73–76

See application file for complete search history.

(56) References Cited

U.S. PATENT DOCUMENTS

| | | | | |
|---|---|---|---|---|
| 160,791 A * | 3/1875 | Perrins | A45B 3/00 135/16 |
| 368,077 A * | 8/1887 | Du Bois | A45B 3/00 135/66 |
| 879,640 A * | 2/1908 | Hockenberry | A45B 3/00 135/66 |
| 1,859,627 A * | 5/1932 | Marsh | A45B 3/00 135/66 |
| 1,993,938 A * | 3/1935 | McDonald | A45D 33/26 132/301 |
| 2,044,251 A * | 6/1936 | McWilliams | A45B 9/02 135/66 |
| 5,441,064 A | 8/1995 | Becker | |
| 6,158,451 A * | 12/2000 | Wu | A45B 3/04 135/16 |
| 6,382,809 B1 * | 5/2002 | Ou-Yang | A45B 3/04 135/910 |
| 6,510,861 B1 * | 1/2003 | Mead | A45B 3/00 135/16 |

(Continued)

FOREIGN PATENT DOCUMENTS

| | | |
|---|---|---|
| CN | 202375258 | 8/2012 |
| CN | 202552205 | 11/2012 |

(Continued)

*Primary Examiner* — Winnie Yip
(74) *Attorney, Agent, or Firm* — Brion Raffoul

(57) ABSTRACT

Systems and devices for rain equipment. A device removably attachable to a top of an umbrella is provided. The device has a receptacle which may contain a thin, folded umbrella or a folded hat, or any other suitable rain gear. The outside of the device is shaped to resemble cartoon characters, sports related items, team logos, or any other suitable shape. The device is configured to attach to the top of the umbrella by an attachment means which uses a screw, a hook and loop mechanism, or friction.

14 Claims, 9 Drawing Sheets

(56) References Cited

U.S. PATENT DOCUMENTS

| | | | | |
|---|---|---|---|---|
| 7,119,679 | B1 * | 10/2006 | Crom | B60Q 1/482 340/539.32 |
| 7,494,236 | B2 * | 2/2009 | Lim | A45B 3/04 362/102 |
| 7,581,555 | B2 | 9/2009 | McCullough | |
| 9,247,793 | B2 | 2/2016 | Hidde et al. | |
| 2008/0072940 | A1 * | 3/2008 | Cheng | A45B 3/00 135/66 |
| 2010/0099329 | A1 * | 4/2010 | Brokering | A45B 25/00 446/352 |
| 2015/0282578 | A1 | 10/2015 | Feldman | |
| 2016/0120278 | A1 | 5/2016 | Gorouvein | |

FOREIGN PATENT DOCUMENTS

| | | | | |
|---|---|---|---|---|
| CN | 203943186 | | 11/2014 | |
| CN | 204070875 | | 1/2015 | |
| CN | 104643435 | | 5/2015 | |
| CN | 205030647 | | 2/2016 | |
| JP | 2014012113 | A * | 1/2014 | A45B 25/28 |
| KR | 2020120000876 | | 8/2013 | |
| KR | 105915820000 | | 7/2015 | |

* cited by examiner

UMBRELLA ACCESSORY

TECHNICAL FIELD

The present invention relates to accessories relating to devices for use in rain or inclement weather. More specifically, the present invention relates to an attachment for use with an umbrella. The attachment may be used to house further rain clothing such as a hat or a raincoat.

BACKGROUND

The use of umbrellas date back thousands of years to the ancient Egyptians and the ancient Chinese. One of their main functions was, of course, to keep the user free from the ravages of rain, i.e. to keep the user from getting wet. However, while umbrellas are good for keeping a user's head from getting wet, the rest of the user's body is subject to not just the rain but the wind that usually accompanies that rain. A raincoat would alleviate the wetness and cold that such a user would experience.

A user wearing a raincoat or a rain poncho and using an umbrella would, therefore, be properly protected from the elements. The umbrella would ensure that most of the rain would be kept away from the user's head and face and the raincoat would ensure that the rest of the user's body (or at least the user's upper body) would be protected from both the rain and the wind.

While the above concept would clearly keep a user relatively free from the ravages of a rainstorm, it does present an inescapable inconvenience—the user would need to carry two items: an umbrella and a raincoat. Unfortunately, there are currently no systems that currently allow a user to conveniently carry both without some inconvenience. One current method involves a hollowed out handle for the umbrella with the raincoat being carried in the handle's hollow. Unfortunately, this requires that the handle be larger than normal. Users with small hands (such as children or people of a small stature) would not be able to conveniently grip the umbrella with one hand, given the girth of the handle. In slightly stronger winds, a child user or a small person user could easily have the umbrella ripped from their grasp.

Other means of carrying a raincoat may involve placing the raincoat in a pouch and hanging the pouch off of the umbrella's handle. Unfortunately, the hanging pouch may become a nuisance to a user, causing the user to forgo being equipped with the raincoat. Similarly, a free hanging raincoat pouch may get snagged or entangled while the user is out walking. Such unfortunate occurrences may lead to distractions and inconveniences to the user.

From the above, there is therefore a need for systems, methods, or devices which mitigate if not overcome the shortcomings of the prior art. A novel means of carrying at least one other item of rain equipment in conjunction with an umbrella and which does not involve a free hanging raincoat pouch would be useful.

SUMMARY OF INVENTION

The present invention relates to systems and devices for rain equipment. A device removably attachable to a top of an umbrella is provided. The device has a receptacle which may contain a thin, folded umbrella or a folded hat, or any other suitable rain gear. The outside of the device is shaped to resemble cartoon characters, sports related items, team logos, or any other suitable shape. The device is configured to attach to the top of the umbrella by an attachment means which uses a screw, a hook and loop mechanism, or friction.

In one aspect, the present invention provides a device for use with an umbrella, the device comprising:

- a receptacle for holding at least one item within the receptacle;
- an attachment mechanism for detachably attaching said device to a top portion of said umbrella;

wherein said receptacle is attached to said attachment mechanism.

BRIEF DESCRIPTION OF THE DRAWINGS

The embodiments of the present invention will now be described by reference to the following figures, in which identical reference numerals in different figures indicate identical elements and in which.

DETAILED DESCRIPTION

Figure 1:
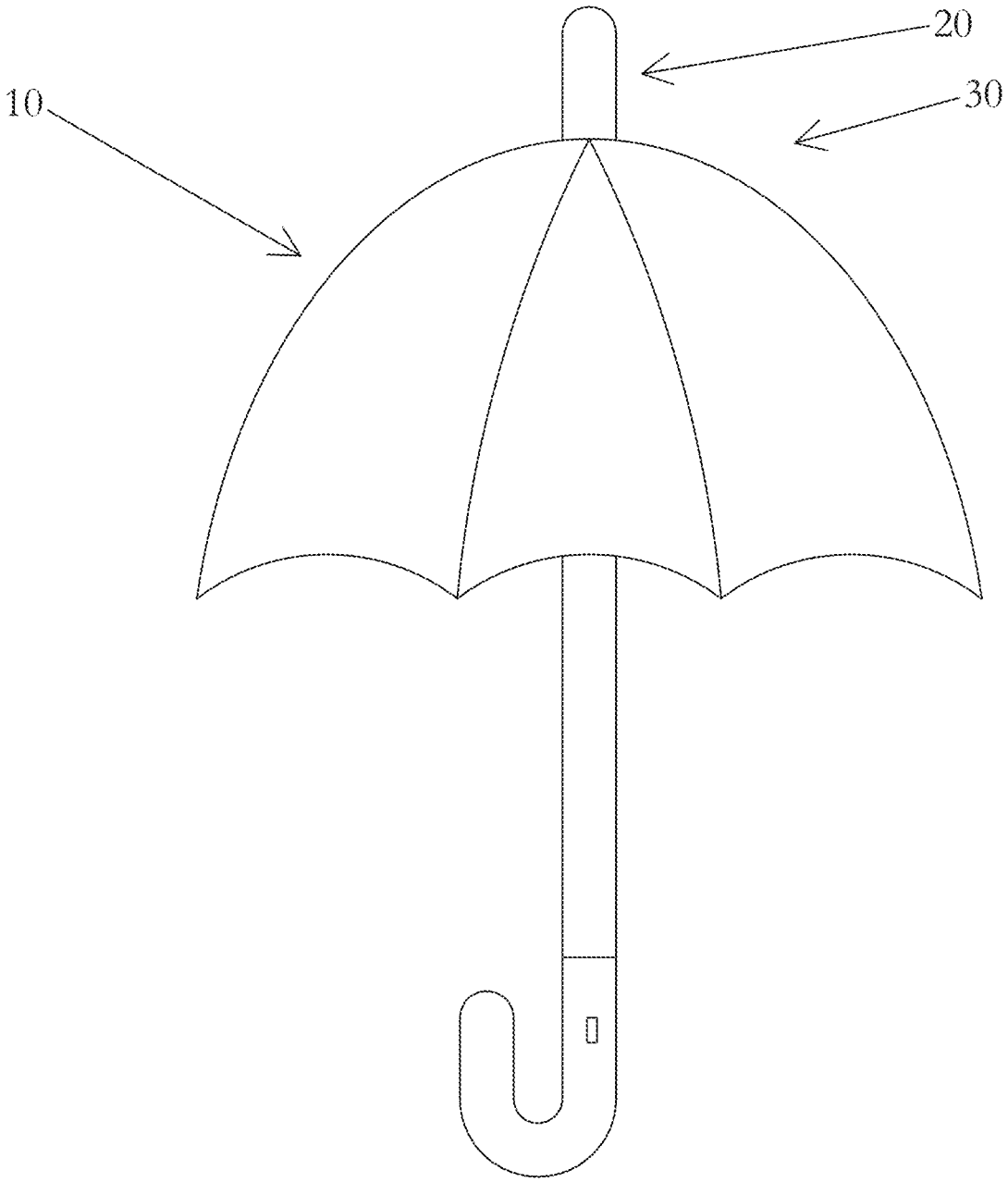
FIG. 1 is an illustration of an umbrella in use with one aspect of the invention.

Referring to FIG. 1, an umbrella 10 is illustrated. As can be seen, a device 20 is attached to a top section 30 of the umbrella 10.

Figure 2:
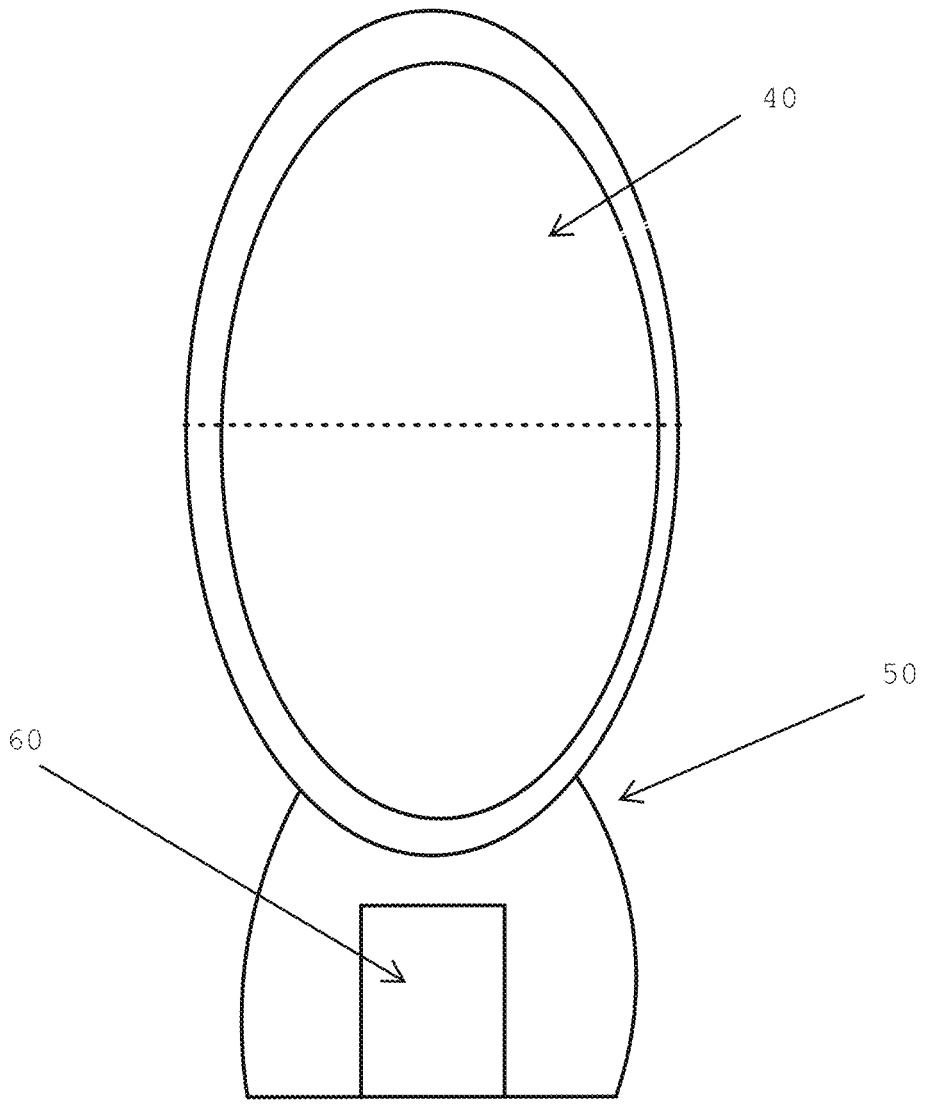
FIG. 2 is a side cut-away view of a device according to another aspect of the invention.

Referring to FIG. 2, a side cut-away view of the device 20 is illustrated. The device 20 is hollow such that a receptacle 40 is formed inside the device 20. An attachment mechanism section 50 forms part of the device 20. The attachment mechanism section includes an attachment mechanism 60 for attaching the device 20 to the top section 30 of the umbrella.

It should be noted that multiple attachment mechanisms may be used for the present invention. In one embodiment, the attachment mechanism 60 is a hollow channel designed to mate with a ferrule or a cap of an umbrella. The hollow channel may be threaded to mate with a corresponding thread on the ferrule or cap of the umbrella or to mate with a corresponding thread on a protrusion at the top of the umbrella. Alternatively, the attachment mechanism may be constructed of hard pliant rubber such that the hollow channel grips the ferrule or cap by means of friction. As another alternative, the hollow channel may grip the ferrule by means of friction and a strap may be used to ensure that the device stays on the umbrella. The strap may be used to ensure that there is sufficient friction between the inside of the hollow channel and the ferrule such that the device does not easily slip off the umbrella. Other attachment mechanisms may also use hook and loop mechanisms or straps to ensure that the device is securedly removably attached to the top of the umbrella. Other mechanisms within the purview of a person skilled in the art could, of course, be used.

Returning to FIG. 2, it can be seen that a receptacle is formed inside the device 20. The receptacle may be used to hold a thin, folded raincoat, a folded poncho, a folded hat, shoe coverings, or any other suitable rain repellent clothing.

In some embodiments, the receptacle is configured to hold multiple pieces of rain repellent clothing.

As can be seen in FIG. 2, the device is, preferably, a closed receptacle to hold the rain repellent clothing. However, in one implementation, the device may use an open receptacle. For such an implementation, the rain repellent clothing can be contained in a suitable container such as a plastic bag and the bag can be held in the receptacle by suitable means such as hook and loop fasteners, straps, friction, clips, and others.

Figure 3A:
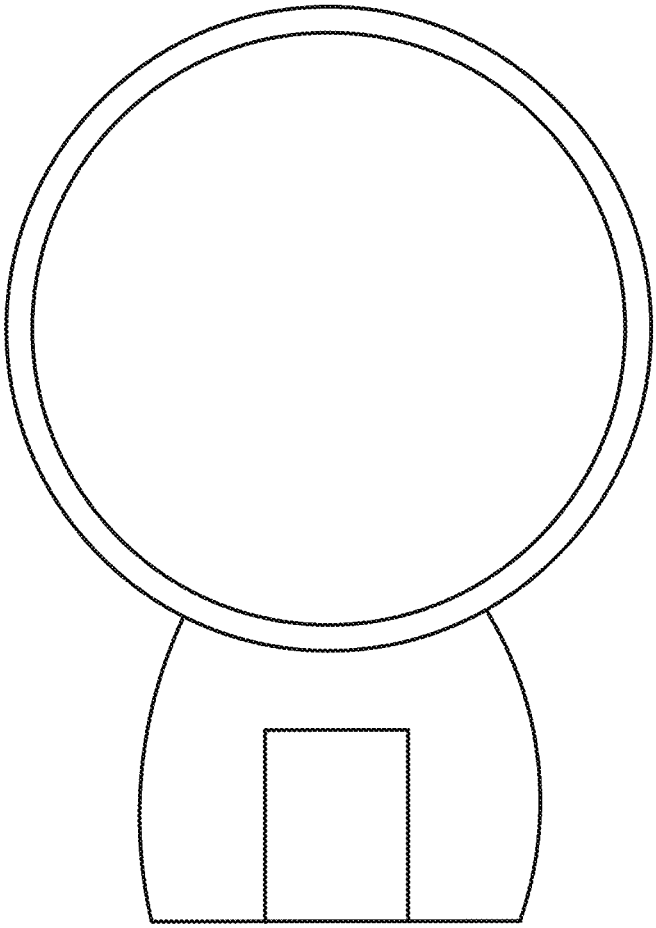
FIGS. 3A and 3B are a side cut-away views of alternative configurations for the receptacle used by the device illustrated in FIG. 2.
Figure 3B:
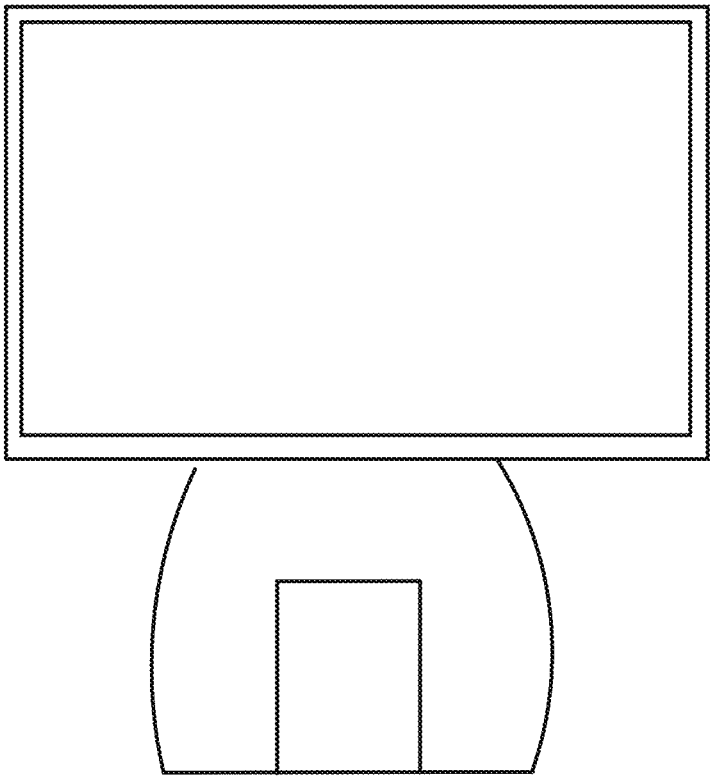

As can also be seen in FIG. 2, the closed receptacle of the device in FIG. 2 is approximately egg-shaped or approximately oblong in shape. Other shapes are, of course, possible. FIGS. 3A and 3B illustrate side cutaway views of alternative shapes for the receptacle. In FIG. 3A, the receptacle is spherical in shape while the receptacle in FIG. 3B is rectangular or generally rectilinear in shape.

Figure 4:
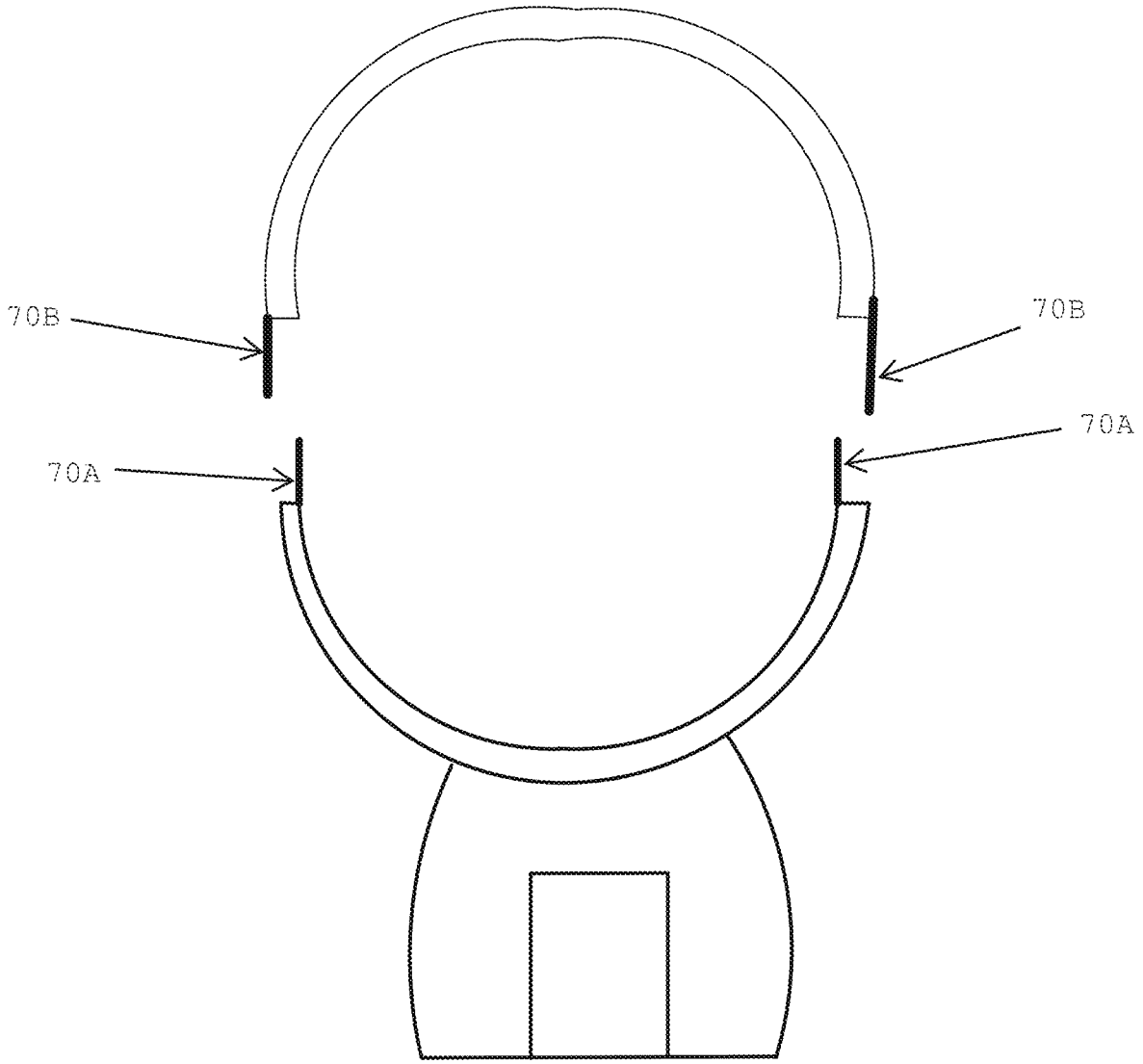
FIG. 4 is a side cut-away view of one configuration of the device according to another aspect of the invention.
Figure 5A:
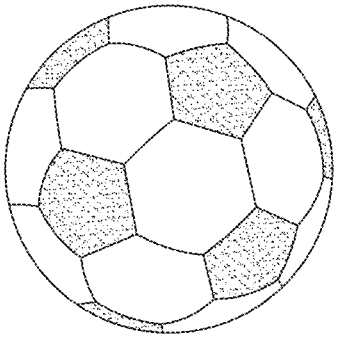
FIGS. 5A-5L are diagrams illustrating different possible designs and configurations for the outside of the device illustrated in FIG. 2.
Figure 5B:
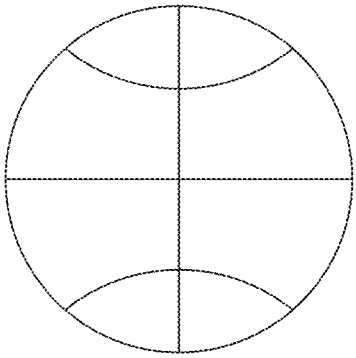
Figure 5C:
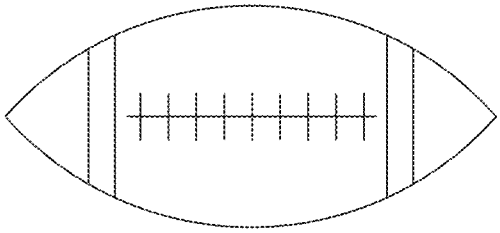
Figure 5D:
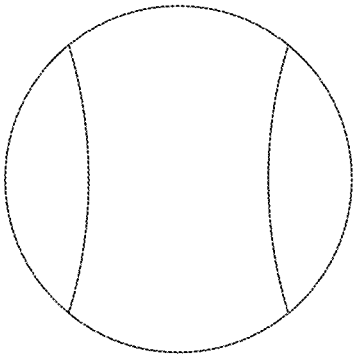
Figure 5E:
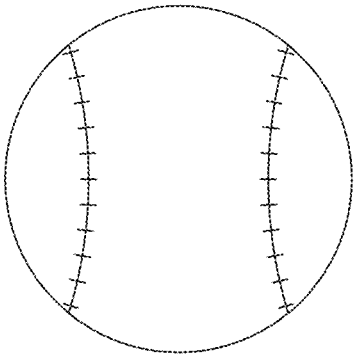
Figure 5F:
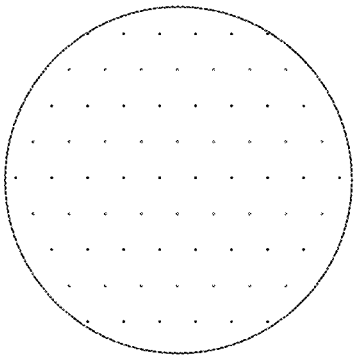
Figure 5G:
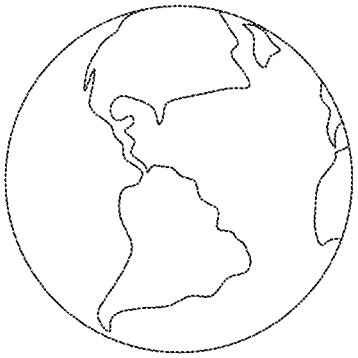
Figure 5H:
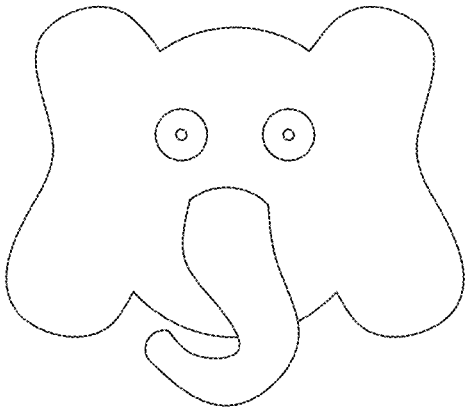
Figure 5I:
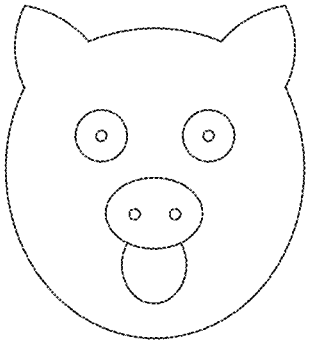
Figure 5J:
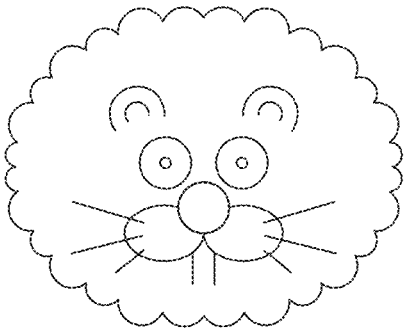
Figure 5K:
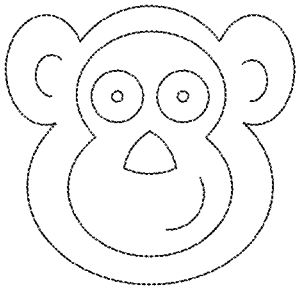
Figure 5L:
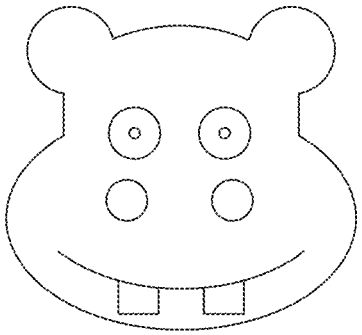

It should be clear that the internal shape of the receptacle may be any shape as long as the rain repellent clothing can be placed within the receptacle. The above Figures illustrate a closed version of the receptacle. The receptacle can be opened by having a lid on the receptacle (such as if the receptacle has a rectilinear shape) or by having a portion of the receptacle be removable. Such a configuration is illustrated in FIG. 4 where an oblong shaped receptacle has its top portion removed in a side cutaway view. As can be seen, the removable top portion is configured to mate with the lower portion by means of a lip 70A on the inner part of the lower portion and a matching lip 70B on the outer part of the top portion. Other configurations are, of course, possible.

In one implementation, the inner portion of the receptacle may be reinforced with a rigid metallic or plastic structure that would provide support for the receptacle's shape. A soft or pliant device with the pliant or deformable receptacle may not, in some implementations, for its intended uses. Similarly, the attachment mechanism may also make use of a rigid structure (whether made of metal or of a rigid plastic material), especially if the attachment mechanism involves a threaded internal structure. The hollow channel referred to above may include a rigid structure to ensure that the internal threading is sufficiently rigid to conform with a mating screw on the ferrule or cap of the umbrella.

While the receptacle holds the rain repellent equipment, the outside of the device may be configured to appeal to the user and/or the people around the user. As an example, the outside of the device may be configured to present a three dimensional design such as a model of a piece of sports equipment (e.g. a model of a football, a basketball, a soccer ball, a hockey puck, etc.), a model of a logo (e.g. a sports team logo, a company logo, a brand logo, etc.), a model of a mascot (e.g. a company mascot, a school mascot, a sports team mascot), or a model of a well-known character (e.g. a cartoon character, a comic book character, a TV animated character, etc.). Similarly, the outside of the device may be configured to present a two-dimensional design or representation of any of the previously listed items. Thus, as examples, the device may present a full 3D image of a cartoon character's head, a piece of sports equipment, or a sports team logo. Similarly, the device may simply have one or two flat surfaces one or more two dimensional representations of any of these items.

Referring to FIGS. 5A-5L, drawings of profiles of an outside of the device are presented. As can be seen, a whole range of potential configurations for the outside of the device may be used.

From the Figures, it can be seen that stylized images of a soccer ball, a basketball, a football, a baseball, a tennis ball, a golf ball, a globe, an elephant, a dog, a lion, a monkey, or a hippopotamus (among others) may be used. In one configuration, the outside profile for the device is user replaceable and, as such, a user may replace a football shaped outside of the device with a profile shaped like a lion's head. Similarly, in another configuration, the device's outside profile or configuration is fixed and a user wishing to use a different profile or appearance for the device would need to replace that device. As such, a device with a profile of a globe would have to be replaced with a device with the profile of a basketball if the user wished to change the appearance of his or her umbrella. In one embodiment, the rain apparel contained in the receptacle has a pattern related to the profile or appearance of the outside of the device. As an example, if the outside of the device is configured to appear as a football, the raincoat contained in the receptacle may have a football motif or design printed on the raincoat. Similarly, a dog or cat shaped outside of the device may use a dog or cat design on the rain apparel contained in the receptacle.

It should also be noted that, in some implementations, the device may also be equipped with an LED (light emitting diode) based light source. This light source may be battery powered using batteries contained in the device and the light source may be configured such that the outside of the device lights up when the light source is powered on. The batteries may be located adjacent to the attachment mechanism section and a switch may be a simple push to activate switch located anywhere on the device. The LED light source itself may be placed on the top of the device or the LED may be located in the middle of the device to allow the device to illuminate the design or profile.

As another possible variant of the above, the device may be equipped with a speaker and a short range radio transceiver. The transceiver could receive and transmit (as necessary) signals to and from a user device such as a smartphone. The transceiver may use short range radio technology such as Bluetooth™ technology.

In another implementation, the device may be equipped with a GPS receiver, a wireless communications module, and at least one suitable power supply to power these electrical devices. For this variant, the GPS receiver can be used to determine the location of the device and, hence, the location of the person with the device-equipped umbrella. The wireless communication module can be configured to communicate with at least one wireless device (e.g. a mobile phone with a suitable app) to transmit the GPS coordinates of the GPS receiver. This configuration allows a mobile phone user to track the device and, thus, to track the person in possession of the umbrella with the device. As an example, a parent may provide his or her child with the umbrella and the device and, in so doing, that parent can track the child's movements. Thus, in addition to providing protection from the elements, the suitably equipped and configured umbrella can be used to provide a measure of safety for the child user.

A person understanding this invention may now conceive of alternative structures and embodiments or variations of the above all of which are intended to fall within the scope of the invention as defined in the claims that follow.

I claim:

1. A device in combination with an umbrella, the device comprising:

a receptacle for holding at least one rain protection item within the receptacle;

an attachment mechanism that detachably attaches said device to a top portion of said umbrella;

wherein said top portion of said umbrella is distal from a handle of said umbrella and is at an opposite end of said umbrella from said handle;

said receptacle is attached to said attachment mechanism.

2. A device according to claim 1, wherein said receptacle is a closed receptacle.

3. A device according to claim 1, wherein an outside of said device has a shape relating to at least one of:

sports;
animals;
plants;
cartoon characters;
fictional characters; and
sports teams.

4. A device according to claim 3, wherein said outside of said device has a shape similar to at least one of:

a football;
a baseball;
a basketball;
a soccer ball;
a tennis ball;
a rugby ball;
a hockey puck;
a golf ball; and
a cricket ball.

5. A device according to claim 1, wherein an outside of said device comprises a three dimensional design.

6. A device according to claim 3, wherein said outside of said device has a shape similar to a head of at least one of:

a dog;
a lion;
a monkey;
a hippopotamus;
a cat; and
an elephant.

7. A device according to claim 1, wherein said at least one rain protection item is for use in protecting a user from inclement weather.

8. A device according to claim 7, wherein said at least one rain protection item is at least one of:

a raincoat;
a hat;
a poncho;
a rain covering for at least one shoe; and
gloves.

9. A device according to claim 1, wherein said attachment mechanism comprises a screw mechanism.

10. A device according to claim 1, wherein said attachment mechanism uses friction to detachably attach said device to said umbrella.

11. A device according to claim 1, wherein said attachment mechanism comprises a hollow portion of said device, said hollow portion being for mating with a corresponding portion of said umbrella.

12. A device according to claim 1 wherein said receptacle comprises a top portion and a lower portion and said top portion is removable from said lower portion.

13. A device according to claim 12 wherein said top portion and said lower portion are configured to mate with each other.

14. A device according to claim 13 wherein a lip on an inner part of said lower portion mates with a matching lip on an outer part of said top portion.

* * * * *